US006672659B1

(12) United States Patent
Melohn et al.

(10) Patent No.: US 6,672,659 B1
(45) Date of Patent: Jan. 6, 2004

(54) CONVERTIBLE TOY CHAIR AND VANITY COMBINATION

(75) Inventors: Richard J. Melohn, Santa Monica, CA (US); Yukha Ann Mo, Torrance, CA (US)

(73) Assignee: Mattel, Inc.

( * ) Notice: Subject to any disclaimer, the term of this patent is extended or adjusted under 35 U.S.C. 154(b) by 0 days.

(21) Appl. No.: 10/322,082

(22) Filed: Dec. 17, 2002

(51) Int. Cl.[7] ..... A47C 13/00

(52) U.S. Cl. ..... 297/118; 297/235; 297/185; 297/236; 297/119; 46/15; 446/478; 446/482

(58) Field of Search ..... 297/118, 119, 297/129, 130, 185, 217.1, 1, 2, 3, 105, 108, 235, 236, 237; 46/15; 312/224, 235.2, 235.4, 240; 446/227, 479, 482, 478, 487, 71, 73

(56) References Cited

U.S. PATENT DOCUMENTS

| | | | | | |
|---|---|---|---|---|---|
| 201,930 | A | * | 4/1878 | Maztin | 182/29 |
| 325,999 | A | * | 9/1885 | Weisgerber, Jr. | 297/3 |
| 389,911 | A | | 9/1888 | Tribbey | |
| 910,818 | A | | 1/1909 | Hook | |
| 1,025,422 | A | * | 5/1912 | Peters | 297/132 |
| 1,107,918 | A | * | 8/1914 | Dimmerling | 297/1 |
| 1,113,960 | A | | 10/1914 | Davidson | |
| 1,283,762 | A | | 11/1918 | Henschel | |
| 1,328,921 | A | | 1/1920 | Howe | |
| 1,559,111 | A | | 10/1925 | Lees | |
| 1,660,119 | A | | 2/1928 | Decker | |
| 1,888,325 | A | * | 11/1932 | McCarroll | 297/118 |
| 1,954,604 | A | * | 4/1934 | Thomas | 297/235 |
| 2,276,308 | A | | 3/1942 | Hugh | |
| 2,348,573 | A | * | 5/1944 | Rogers | 297/142 |
| 2,601,374 | A | | 6/1952 | Ditzler et al. | |
| 2,620,018 | A | * | 12/1952 | Pagano | 297/123 |
| 2,720,911 | A | * | 10/1955 | Lantz | 280/30 |
| 2,754,889 | A | * | 7/1956 | Lovelace | 297/118 |
| 3,402,962 | A | * | 9/1968 | Ellis et al. | 297/130 |
| 3,614,155 | A | | 10/1971 | Campbell | 297/129 |
| 3,675,363 | A | * | 7/1972 | Mills | |
| 4,153,958 | A | | 5/1979 | Paulik | 5/12 R |
| 4,205,876 | A | | 6/1980 | Cetina | 297/118 |
| 4,382,627 | A | | 5/1983 | Dean | 297/124 |
| 4,506,927 | A | | 3/1985 | Lombardo | 297/118 |
| 4,527,829 | A | * | 7/1985 | Fanslau et al. | 297/17 |
| 4,645,261 | A | | 2/1987 | Bourne et al. | 297/118 |
| 5,100,198 | A | * | 3/1992 | Baltzell | 312/235.2 |
| 5,230,523 | A | * | 7/1993 | Wilhelm | 280/30 |
| 5,352,013 | A | | 10/1994 | Rusyniak | 297/119 |
| 5,356,197 | A | | 10/1994 | Simic | 297/129 |
| 5,507,549 | A | | 4/1996 | Cope | 297/129 |
| 5,597,199 | A | | 1/1997 | Hoffman et al. | 297/144 |
| 5,611,762 | A | | 3/1997 | Kaye | 482/104 |
| 5,647,632 | A | * | 7/1997 | Fireman | 297/109 |
| 6,367,873 | B1 | | 4/2002 | Dorner et al. | 297/110 |
| 6,367,874 | B2 | | 4/2002 | Casini | 297/118 |
| 6,402,231 | B1 | | 6/2002 | Pedemonte | 297/17 |

* cited by examiner

*Primary Examiner*—Peter M. Cuomo
*Assistant Examiner*—Erika Garrett
(74) *Attorney, Agent, or Firm*—James G O'Neill; Klein O'Neill & Singh, LLP

(57) ABSTRACT

A toy that is easily convertible between a toy lounge chair and a toy vanity for a doll. The toy has a main body with a base and a pair of sides with a number of movable sections secured to the base. The main body has two faces, one of which forms portions of the lounge chair and the other of which forms portions of the vanity. A separate leg assembly is selectively moved to act as a support for the lounge chair or the vanity. The movable sections are rotatable so as to reveal face portions that form a mirror and a box-like compartment or drawer of the vanity, or a seat back, seating base and a single or two piece leg rest for the lounge chair. The leg assembly may be hingedly attached to or be formed separate from the main body.

11 Claims, 3 Drawing Sheets

CONVERTIBLE TOY CHAIR AND VANITY COMBINATION

BACKGROUND OF THE INVENTION

1. Field of the Invention

This invention generally relates to toys, and more particularly, to an improved toy lounge chair that is convertible into a vanity and back, for more enjoyment by a child during play.

2. Description of the Prior Art

The convertible furniture art is old and crowded and includes many types of pieces that convert from one form or type of furniture or device into one or more other forms or types of furniture or devices and back. Such known pieces include convertible or foldable toy furniture of the type shown in U.S. Pat. No. 1,283,762 and nesting toy furniture sets as shown in U.S. Pat. Nos. 1,328,921 and 1,660,119. However, none of the known prior art discloses or shows a toy lounge chair that is convertible into a toy vanity and back by moving or rearranging a number of elements.

Therefore, there still exists a need in the art for a toy device that more effectively and efficiently transforms from a lounge chair to a vanity and back in a minimum of time by moving a minimum number of parts thereof. There also exists a need for a method of assembling and manufacturing such a convertible toy lounge chair/vanity in an inexpensive and efficient manner and to allow a child to easily and quickly manipulate the same during play.

SUMMARY OF THE INVENTION

Accordingly, it is a general object of the present invention to provide an improved and simplified convertible toy. It is a particular object of the present invention to provide an improved and simplified convertible toy chair and vanity. It is a further particular object of the present invention to provide an improved and simplified toy chair that is easily converted into a vanity and back. It is a yet a further particular object of the present invention to provide an improved and simplified toy lounge chair that is easily converted into a vanity and back, by manipulating a leg assembly on the toy and folding the body of the toy into a chair or a vanity position with the leg assembly supporting the underside of the chair or vanity. And, it is a still further particular object of the present invention to provide an improved and simplified method of converting a toy into or from a vanity from or into a lounge chair, by manipulating a leg assembly and unfolding a body to reveal a chair or vanity on the opposed sides and then moving the body and leg assembly so as to support the lounge chair or vanity in an open or usable play position.

These and other objects of the present invention are achieved by providing a toy that is easily convertible between a lounge chair and vanity. The toy includes a main body having two faces, one of which comprises portions of a lounge chair and the other of which comprised portions of a vanity. A separate leg assembly is provided that is selectively moved to act as a support for the lounge chair or the vanity. The body includes hinged portions that fold to reveal face portions that form a mirror and a box-like main portion of the vanity, or the seat back, seating portion and a leg rest for the lounge chair. The leg assembly may be hingedly attached to or formed separate from the main body.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
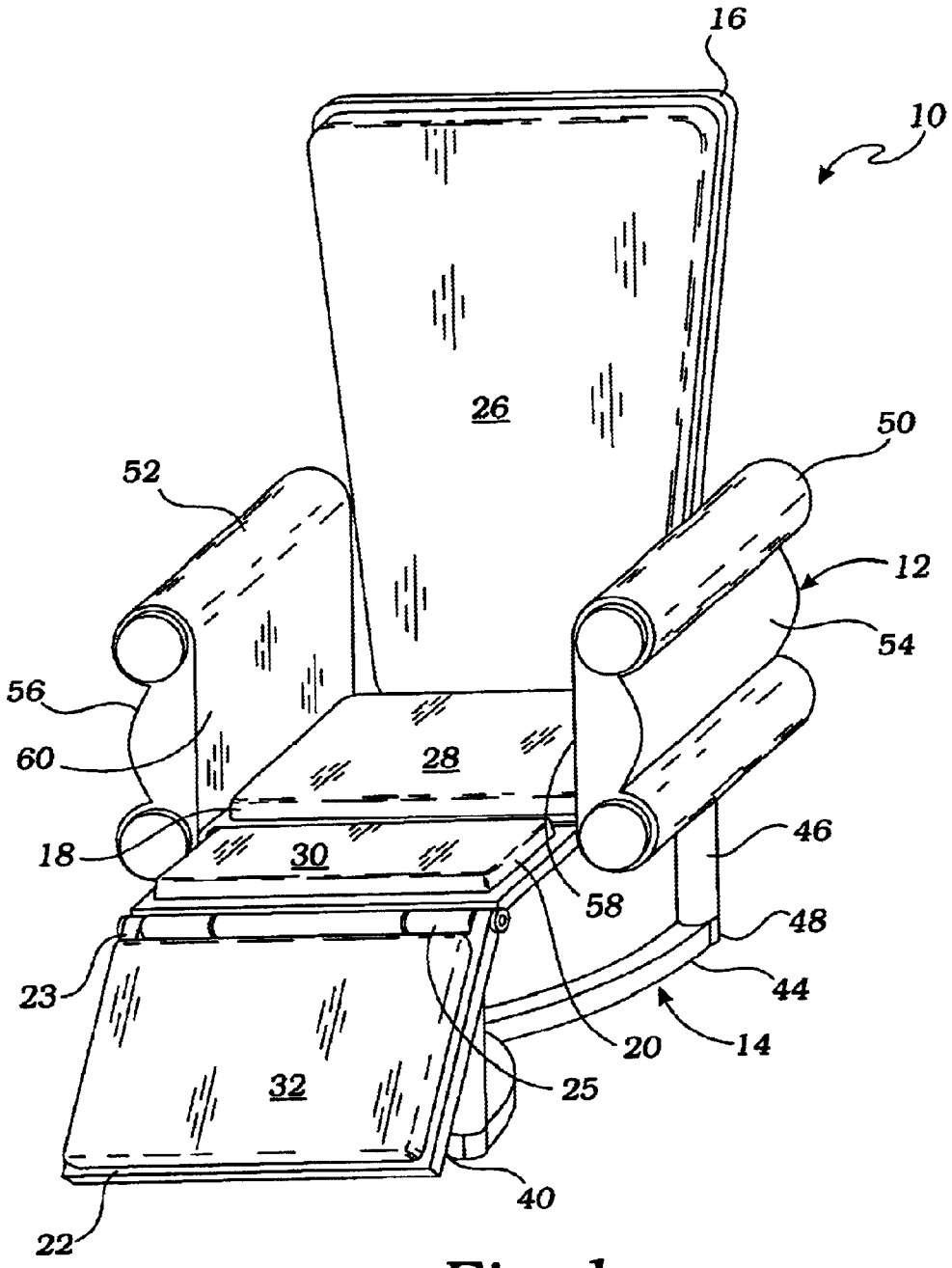
FIG. 1 is a perspective view of a convertible toy of the present invention in a lounge chair configuration.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved and simplified convertible toy lounge chair/vanity generally indicated at 10.

The toy lounge chair/vanity 10 has a main body portion 12 and a leg assembly 14. The body portion 12 is comprised of at least two sections and preferably four (4) or more sections indicated at 16, 18, 20, 22. The sections 16, 20, 22 are preferably movable with respect to the base section 18 and each other, as by means of connecting or movable portions 23, 24, 25, such as any type of hinge or connecting portion. Each of the sections 16, 18, 20, 22 includes a first or front face or surface 26, 28, 30, 32 and a second or rear face or surface 34, 36, 38 and the bottom or back section 22, indicated by a numeral 40 in FIG. 1, having the surface 32 on the front, as explained more fully below.

The leg assembly 14 of the convertible toy lounge chair and vanity 10 may take any desired form or shape and may be movably secured to or separate from the main body 12. The leg assembly 14 is illustrated as being open and comprised of two (2) leg members 42, 44 connected together by arms, brackets or slats 46. Each of the leg members 42, 44 includes a plurality of shaped outer ends 48, which can take various configurations, some of which act as feet, and to which the brackets 46 are connected. The leg portions 42, 44 are contoured or shaped to be aesthetically pleasing to a child playing with the toy and of sufficient size to adequately and safely support the chair or vanity in the desired positions shown.

Figure 3:
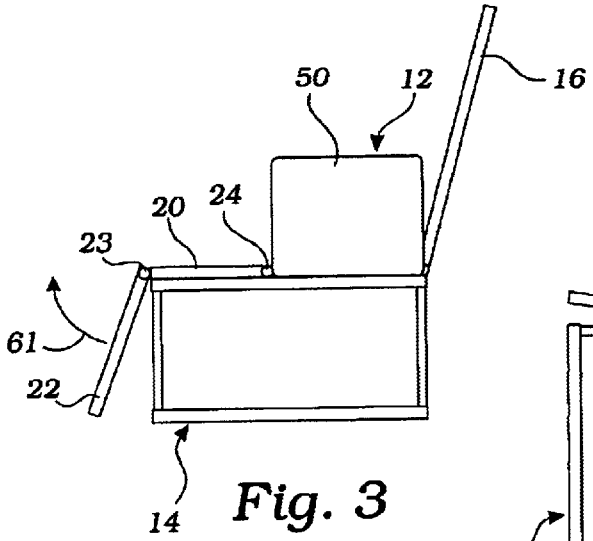
FIGS. 3–6 are diagrammatic views showing how the toy of the present is manipulated to change it from a toy lounge chair, as shown in FIG. 3, to a vanity, as shown in FIG. 6, and back.
Figure 4:
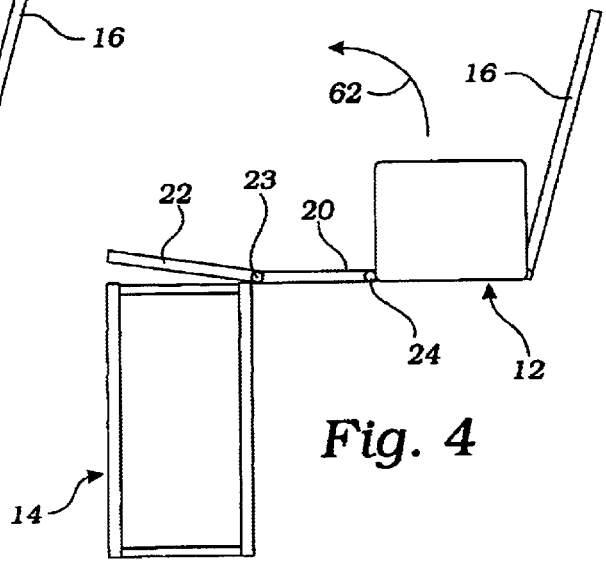
Figure 5:
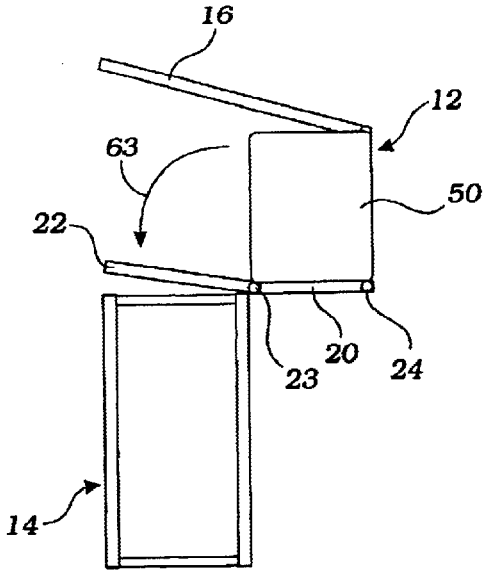

The leg portions may be separate from the body 12 and include hooked or bent ends that may be selectively captured in one or more handle portions for a simulated drawer, formed on surface 38 of section 20 of the body, when in the chair configuration shown in FIGS. 1 and 3.

As best shown in FIG. 1, the first or front face or surface of each section of the body 12 includes simulated portions of a lounge chair thereon, for example a chair back 26, a base or seat 28, a leg supporting portion 30 and a rotatable leg assembly covering or further leg supporting portion 32.

Additionally, the body 12 includes a pair of vertical portions or side walls 50, 52 connected to the base or seat 28, of section 18 and having first or outer faces 54, 56 and second or inner faces 58, 60 which act as arms and side supports for a doll placed in the seat or exterior and interior walls for a compartment or simulated drawer of a vanity, as explained more fully below.

Figure 2:
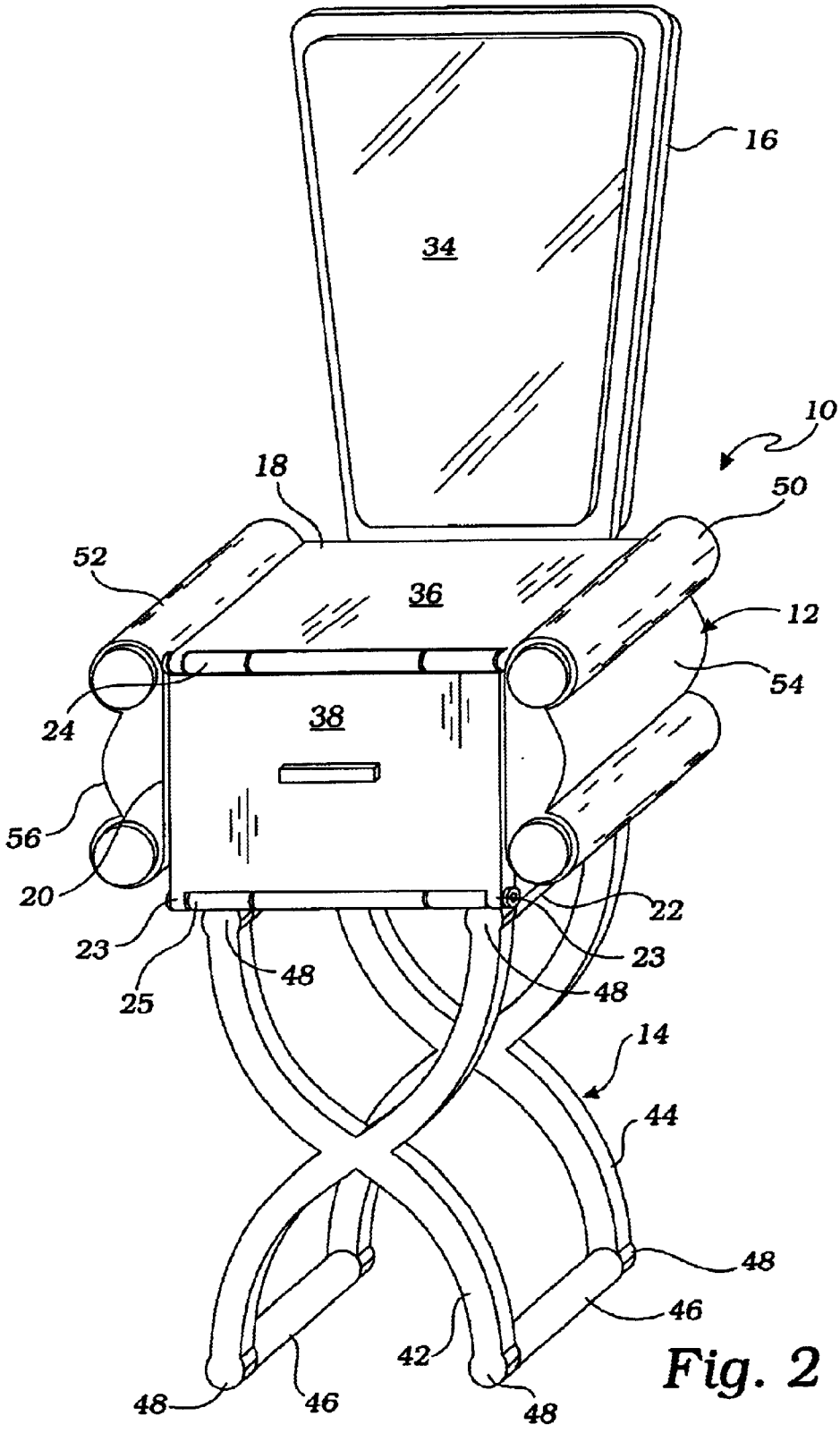
FIG. 2 is a further perspective view of the convertible toy of the present invention a vanity configuration.

As best shown in FIG. 2, the second or rear face or surface of each section 16, 18, 20, 22 include portions of a vanity, including a simulated mirror 34 (opposite face 26), a simulated vanity top 36 (opposite face 28 of base 18), a simulated compartment or drawer front 38 (opposite face 30) and a bottom 40 (opposite face 32) of the simulated compartment or drawer. One end of the leg assembly 14 rests against bottom in the vanity configuration (see FIGS. 2 and 6).

The toy 10 may be made in any desired manner in any desired size, from any desired material, but is preferably made from plastic to be usable with a child playing with dolls, such as a fashion doll. For example, the body 12 and leg assembly 14 of the toy 10 may be molded or otherwise formed in one or more pieces having any desired color or finish.

In one preferred embodiment of the invention, the toy 10 has the following approximate measurements in a vanity configuration: between about 8.5" and 9" high, 2.7" to 2.9" wide and 2" to 2.2" wide. The leg assembly 14 is about 3"–3.2" high and 2.25" to 2.3" wide with the mirror portion being about 3.9" to 4.0" high.

Figure 6:
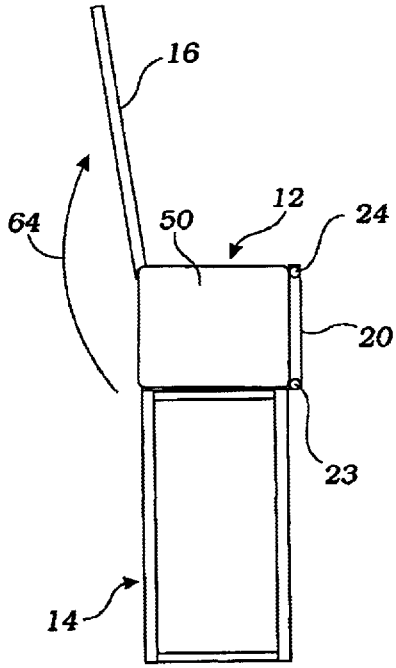

Turning now to FIGS. 3–6, the method of use or operation of the toy 10 on the present invention will be described. Starting in the lounge chair position shown in FIG. 3 (diagrammatic side view of FIG. 1) the section 22, which may include a detent or ratchet means to keep it in an angled position, as shown in FIGS. 1 and 3, is rotated up, in the direction of arrow 61, on hinge portion 23 (at the outer ends of a pin or other connecting means to the section 20). The leg assembly 14 is then rotated about the hinge portion 25 (on the same pin or other connection to the section 20 as the hinge portion 23) and the base portion 12 moved toward the leg assembly, in the direction of arrow 62 shown in FIG. 4 and arrow 63 shown in FIG. 5, until the vanity compartment or simulated drawer is formed by the sections 18, 22, 20 and the leg assembly 14 has one end resting against the bottom 40 (as shown in FIG. 6) and the first section 16 rotated in the direction of the arrow 64 to form the vanity as shown in FIGS. 2 and 6. The first section 16 may include a detent or friction means to enable the back to be posed at an angle.

The entire process is then reversed to reform or return to the lounge chair configuration shown in FIGS. 1 and 3.

If the leg assembly 14 is not movably or rotatably attached to the body 12, the face 38 of the body 12 may be provided with one or more simulated drawer handle portions having openings therein to which shaped or hooked outer ends of the leg assembly may be inserted and held when the toy 10 is in the lounge chair configuration. That is, to transform the toy 10 from a vanity to a chair, the leg assembly would be disconnected, the vanity unfolded to reveal the chair face or surface on the other side, and then the leg assembly would be slid sideways under the chair and into the handle(s) for the drawer to create the chair base and the completed chair. The chair would then be transformed back into a vanity by disconnecting the leg assembly from the drawer handle(s), folding the chair back into the vanity position, and then inserting or reattaching the leg assembly in an upright position under the vanity.

There has thus been described a novel and unique toy which is easily and simply converted between a lounge chair and vanity by a child during play, with or without a doll.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. A convertible toy chair and vanity combination, wherein the improvement comprises:

a body comprised of a pair of vertical sides secured to a horizontal base with a plurality of sections movably connected to the base;

the plurality of sections and the base have first surfaces forming portions of a simulated chair and second surfaces forming portions of a simulated vanity;

the portions of the simulated chair including a back portion, a seat portion on the base, a leg supporting portion and a leg assembly covering portion;

the portions of the simulated vanity including a simulated mirror portion, a vanity top portion on the base, a simulated drawer front portion and a vanity bottom portion;

a leg assembly movable with respect to the base; the leg assembly having a plurality of sides, a first end and a second end; and a plurality of leg members formed on the leg assembly and connected together by a plurality of brackets; the plurality of leg members including a plurality of shaped outer ends to which the brackets are connected;

wherein the plurality of sections are rotated on hinge portions with respect to the base, between a vanity configuration and a chair configuration, with the leg assembly movable between a vanity configuration support and a chair configuration support.

2. The convertible toy chair and vanity combination of claim 1 wherein the leg assembly is rotatably mounted to at least one of the plurality of sections.

3. The convertible toy chair and vanity combination of claim 2 wherein there are three sections, with a first of the three sections rotatably mounted to a second of the three sections movably connected to the base.

4. The convertible toy chair and vanity combination of claim 3 wherein the leg assembly and the first of the three sections are both rotatably mounted to the second of the three sections movably connected to the base.

5. The convertible toy chair and vanity combination of claim 1 wherein there are three sections, with a first of the three sections rotatably mounted to a second of the three sections movably connected to the base.

6. The convertible toy chair and vanity combination of claim 5 wherein the leg assembly and the first of the three sections are both rotatably mounted to the second of the three sections movably connected to the base.

7. A toy convertible between a simulated chair and simulated vanity comprising:

a body having a pair of vertical sides secured to a base and a plurality of rotatable sections connected to the base;

the plurality of rotatable sections and the base have first surfaces forming portions of the simulated chair and second surfaces forming portions of the simulated vanity;

the portions of the simulated chair including a rotatable back portion, a fixed seat portion, a rotatable leg supporting portion and a leg assembly covering portion rotatably secured to the leg supporting portion;

the portions of the simulated vanity including a rotatable simulated mirror portion, a vanity top portion, a rotatable simulated drawer front portion and a vanity bottom portion rotatably secured to the rotatable simulated drawer front portion;

a leg assembly mounted on the body and movable with respect to the base; the leg assembly having a plurality of sides, a first end and a second end;

a plurality of leg members formed on the leg assembly and connected together by a plurality of brackets; the plurality of leg members including a plurality of shaped outer ends to which the brackets are connected; and the leg assembly being rotatably mounted on a first of the plurality of sections; and wherein the plurality of sections are rotated on hinge portions with respect to the base, between a vanity configuration and a chair configuration, with the leg assembly being rotatable between a vanity configuration support and a chair configuration support.

8. The convertible toy chair and vanity combination of claim 7 wherein there are three sections, with a first and a second of the three sections being rotatably secured to the base and a third of the three sections, which third section is rotatably mounted to a selected one of the first and the second of the three sections rotatably secured to the base.

9. The convertible toy chair and vanity combination of claim 8 wherein the leg assembly and the third of the three sections are both rotatably mounted to the selected one of the first and the second of the three sections rotatably secured to the base.

10. A method of converting a toy chair to a toy vanity, comprising the steps of:

providing a toy body having a pair of vertical sides secured to a horizontal base and a plurality of sections movably connected to the base;

providing the plurality of sections and the base with first surfaces forming a back portion, a seat portion, a leg supporting portion and a leg assembly covering portion of a simulated chair and second surfaces forming a simulated mirror portion, a vanity top portion, a simulated drawer front portion and a vanity bottom portion of a simulated vanity;

providing a leg assembly;

rotating a first of the plurality of sections toward a second of the plurality of sections;

rotating the first of the plurality of sections and the second of the plurality of sections toward the horizontal base and the pair of spaced vertical walls to form a simulated vanity drawer portion;

moving the leg assembly so as to have one end thereof against the vanity bottom portion; and rotating the simulated mirror portion to form the vanity.

11. The method of claim 10 including the further steps of transforming the toy vanity back to a chair by rotating the simulated mirror portion; moving the leg assembly so as to remove the one end thereof from the vanity bottom portion; and rotating the first of the plurality of sections and the second of the plurality of sections away from the horizontal base and the pair of spaced vertical walls to form the chair.

* * * * *